US009245705B1

(12) United States Patent
Beers et al.

(10) Patent No.: US 9,245,705 B1
(45) Date of Patent: Jan. 26, 2016

(54) CUTOUT BOX FUSE BYPASS JUMPER

(71) Applicants: Ryan Beers, Phillipsburg, NJ (US); Gary Patrissi, Phillipsburg, NJ (US)

(72) Inventors: Ryan Beers, Phillipsburg, NJ (US); Gary Patrissi, Phillipsburg, NJ (US)

( * ) Notice: Subject to any disclaimer, the term of this patent is extended or adjusted under 35 U.S.C. 154(b) by 35 days.

(21) Appl. No.: 14/477,583

(22) Filed: Sep. 4, 2014

(51) Int. Cl.

| | |
|---|---|
| ***H01R 11/01*** | (2006.01) |
| ***H01H 61/01*** | (2006.01) |
| ***H01H 85/02*** | (2006.01) |
| ***H01R 11/22*** | (2006.01) |
| *H01H 31/12* | (2006.01) |

(52) U.S. Cl.
CPC ..... *H01H 61/01* (2013.01); *H01H 85/0208* (2013.01); *H01R 11/22* (2013.01); *H01H 31/127* (2013.01); *H01H 2085/0216* (2013.01)

(58) Field of Classification Search
CPC . H01H 31/127; H01H 61/01; H01H 85/0208; H01H 2085/0216; H01H 2207/016; H01R 11/22; H01R 11/24
USPC ..... 337/156, 174, 178; 439/370, 507, 511, 439/513
See application file for complete search history.

(56) References Cited

U.S. PATENT DOCUMENTS

| | | | | |
|---|---|---|---|---|
| 2,287,499 | A | 6/1942 | Smith, Jr. | |
| 2,347,851 | A | 5/1944 | Steinmayer et al. | |
| 2,438,746 | A * | 3/1948 | Garrison | H01R 11/14 200/325 |
| 2,689,944 | A | 9/1954 | Curtis | |
| 2,728,055 | A | 12/1955 | Curtis | |
| 2,728,056 | A | 12/1955 | Montmollin | |
| 2,816,985 | A * | 12/1957 | Lindell | H01H 31/006 218/12 |
| 2,928,067 | A * | 3/1960 | Broberg, Jr. | F02B 75/34 439/626 |
| 3,032,630 | A | 5/1962 | McCloud et al. | |
| 3,774,137 | A | 11/1973 | Carothers | |
| 5,650,602 | A * | 7/1997 | Wood | H01H 85/0208 200/17 R |
| 6,359,229 | B1 | 3/2002 | Larson et al. | |
| 6,705,888 | B2 * | 3/2004 | Palet Mercader | H01R 9/2458 439/507 |
| 2010/0245023 | A1 * | 9/2010 | Massingill | H01H 85/042 337/171 |

* cited by examiner

*Primary Examiner* — Anatoly Vortman
*Assistant Examiner* — Jacob Crum
(74) *Attorney, Agent, or Firm* — Thomas J. Germinario

(57) ABSTRACT

The fuse bypass jumper of the present invention bridges the upper and lower fuse terminals of a high-voltage transmission line cut-out box so as to bypass the fuse element. The jumper comprises lateral upper and lower arms connected by a longitudinal jumper bar. The jumper arms and bar are made of a heavy gauge conductor rated for at least 100 Amps. With the jumper in place, the fuse element can be opened, removed and/or replaced without interrupting the transmission line circuit through the cut-off box, since the jumper now provides a bypass around the fuse. Since the bypass conductive path constitutes a heavy gauge, high-amperage bar conductor, this jumper can carry a much larger current load than flexible wire-based jumpers.

4 Claims, 8 Drawing Sheets

CUTOUT BOX FUSE BYPASS JUMPER

FIELD OF INVENTION

The present invention relates to the field of devices used in connection with the repair and maintenance of high voltage, high amperage power line facilities. More particularly, the present invention relates to devices used to bypass active power line fuses in connection with the inspection and/or replacement of such fuses.

BACKGROUND OF THE INVENTION

In high-voltage, high-amperage electrical transmission lines, fuses are used for protection against current overloads. Such fuses are typically incorporated in devices known as "cut-out boxes." A cut-out box is a substantially rectangular structure, one side of which comprises a replaceable fuse element. As depicted in FIGS. 1 and 2, the lower end of the fuse element is typically rotatably attached to the cut-out box, while the upper end engages a spring-loaded contact. As shown in FIG. 2, the fuse element can be opened by rotating it outward, using a ring or "eye" attached to the fuse, and then removed by lifting its rotatable lower end from its cradle.

When a cut-out box fuse is removed for inspection and/or replacement, the open side of the cut-out box must be jumpered so that the transmission of electrical current is not interrupted. This is a difficult and hazardous operation that requires at least two workers to connect both ends of the jumper across the cut-out box. Standard jumpers usually incorporate a tension coil spring to provide a secure contact with the cut-out box on either end, and this requires stretching the jumper between its contact points, often using a "hot stick" to stretch the jumper.

Examples of stretchable coil spring jumpers are disclosed in the U.S. patents of Steinmayer et al. (U.S. Pat. No. 2,347,851), deMontmollin (U.S. Pat. No. 2,728,056), Curtis (U.S. Pat. Nos. 2,689,944 and 2,728,055), and Larson et al. (U.S. Pat. No. 6,359,229). These designs have within the coil spring a flexible wire conductor that provides the bypass path around the fuse for the electrical current. But these stretchable jumpers have two major drawbacks. First, the operation of stretching the spring-tensioned jumper across the cut-out box is awkward and difficult to perform, especially in high-voltage lines where gloved jumper handling is not permitted and a "hot-stick" must be used. Second, since the bypass wire connector must be flexible enough to stretch out with the surrounding coil spring, the gauge of the bypass wire is severely limited, and such flexible wire connectors are not rated above 100 Amps.

The present invention overcomes these difficulties by providing a cutout box fuse bypass jumper than can safely be installed and removed by a single worker and that bridges the fuse terminal contacts with a heavy-gauge, high-amperage coupling conductor, suitable for currents above 100 Amps.

SUMMARY OF THE INVENTION

The fuse bypass jumper of the present invention bridges the upper and lower fuse terminals of a high-voltage transmission line cut-out box so as to bypass the fuse element. The jumper comprises lateral upper and lower arms connected by a longitudinal jumper bar. The jumper arms and bar are made of a heavy gauge conductor rated for at least 100 Amps.

The upper arm of the jumper comprises a lateral channel, which is internally tensioned by a blade spring so as to be securely transversely attachable to the upper fuse terminal or an extension thereof. The lower arm of the jumper comprises a longitudinal notch, which is internally tensioned by two blade springs so as to be securely transversely attachable to the lower fuse terminal or an extension thereof.

The jumper can be attached to cut-off box by a single worker. The upper and lower jumper arms are perpendicularly aligned with the upper and lower fuse terminals/terminal extensions of the cut-off box. Next the notch of the lower jumper arm is transversely engaged with the lower fuse terminal/extension. The jumper arm is then rotated forward so as that the lateral channel transversely engages the upper fuse terminal/extension. The tension of the upper and lower blade springs of the jumper maintain the engagement between the fuse terminals/extensions and the jumper arms.

With the jumper in place, the fuse element can be opened, removed and/or replaced without interrupting the transmission line circuit through the cut-off box, since the jumper now provides a bypass around the fuse. Since the bypass conductive path constitutes a heavy gauge, high-amperage bar conductor, this jumper can carry a much larger current load than flexible wire-based jumpers.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 1:
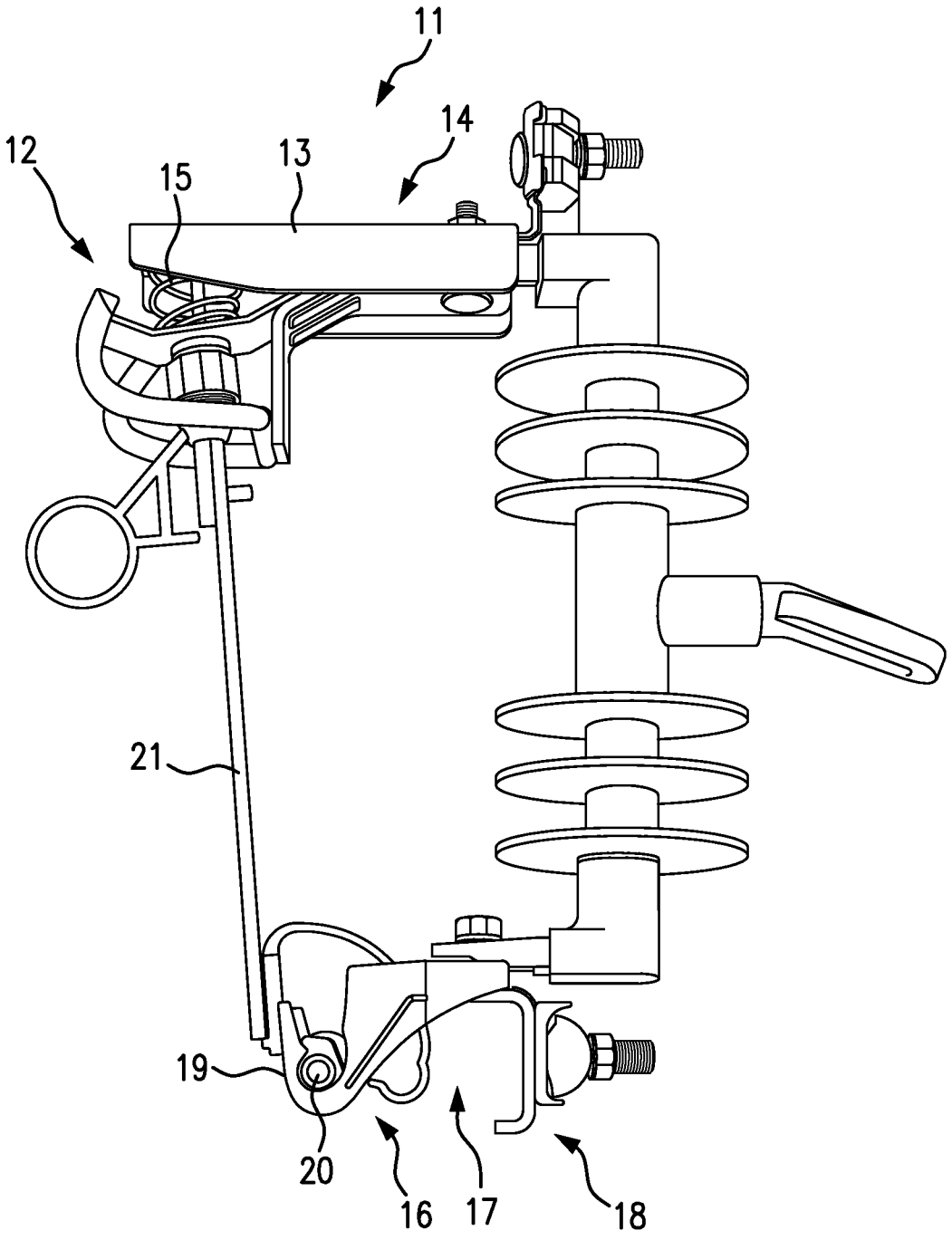
FIG. 1 is a side profile view of an exemplary closed cut-out box, in conjunction with which the preferred embodiment of the present invention is used.
Figure 2:
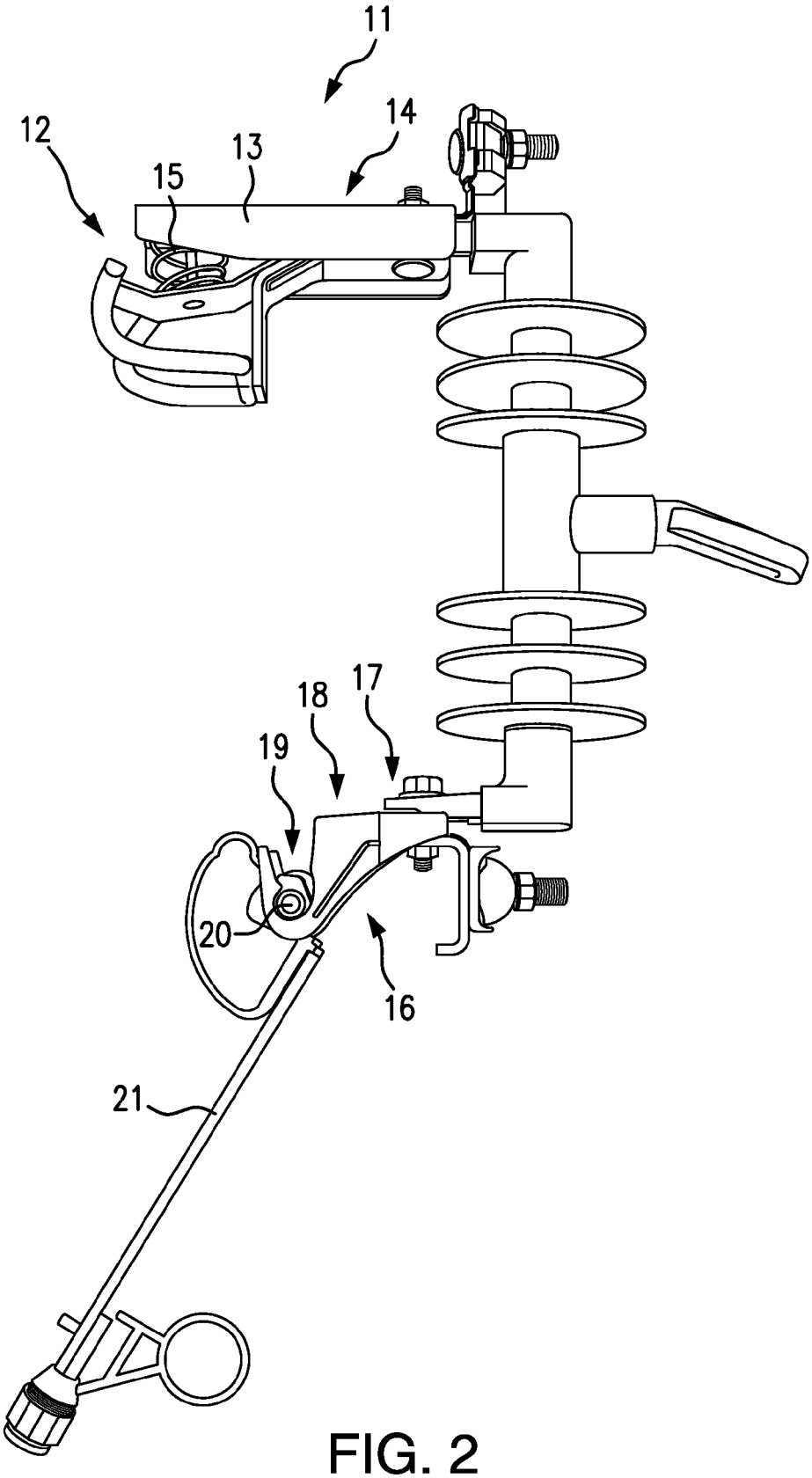
FIG. 2 is a side profile view of an exemplary open cut-out box, in conjunction with which the preferred embodiment of the present invention is used.

Referring to FIGS. 1 and 2, the fuse bypass jumper of the present invention 10 functions in conjunction with a cut-out box 11 in a high-voltage electrical transmission circuit. The cut-out box 11 has an upper fuse terminal 12 electrically connected to an upper terminal extension 13, which forms the upper lateral arm 14 of the cut-out box. The upper fuse terminal 12 is typically tensioned with a coil spring 15. The cut-out box 11 also has a lower fuse terminal 16 electrically connected to a lower terminal extension 17, which forms the lower lateral arm 18 of the cut-out box 11. The lower fuse terminal 16 typically includes a fuse cradle 19 which accepts an axial pin or rod 20 on the lower end of the fuse element 21, so that the fuse element 21 can be rotated upward to engage the upper fuse terminal 12 and complete the circuit through the cut-off box 11, as depicted in FIG. 1. The fuse element 21 can also be rotated downward to disengage from the upper fuse terminal 12 and interrupt the circuit, as depicted in FIG. 2.

In the open position shown in FIG. 2, the fuse element 21 can be removed from the cradle 19 and inspected or replaced. But before this is done, the fuse bypass jumper 10 must be attached to the cut-out box 11 to avoid a circuit interruption in the power line.

Figure 3:
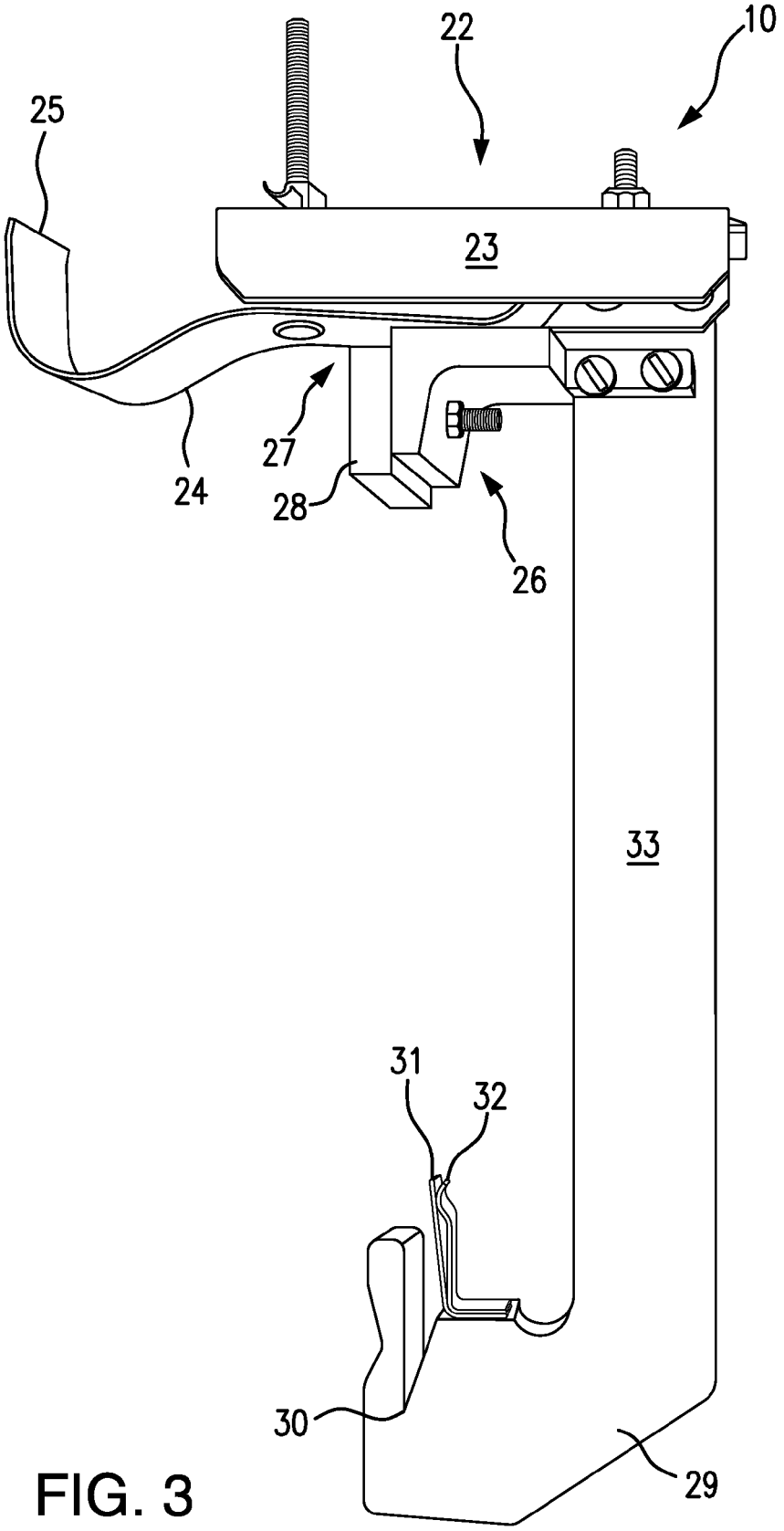
FIG. 3 is a side profile view of the fuse bypass jumper in accordance with the preferred embodiment of the present invention.
Figure 4:
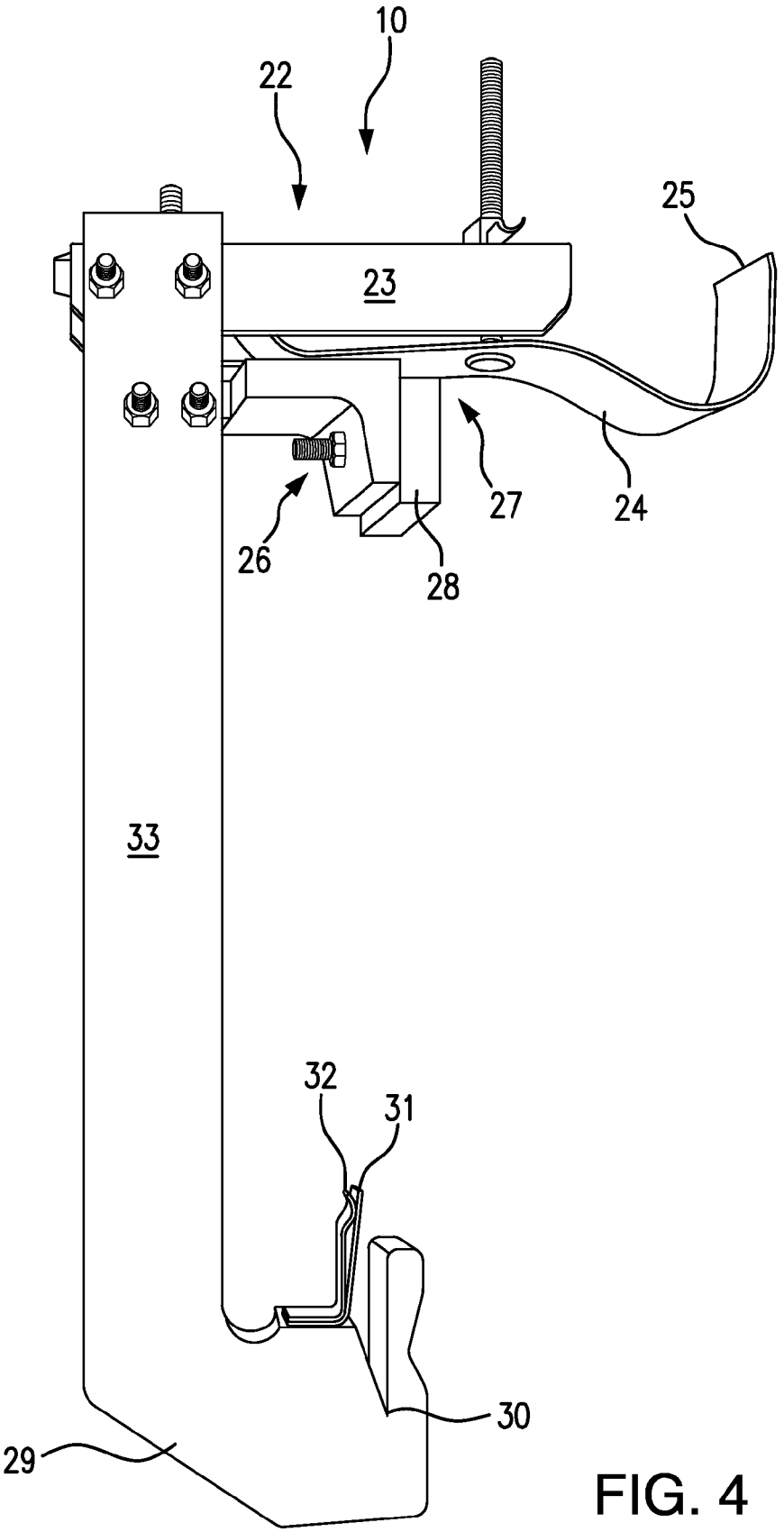
FIG. 4 is a side profile view of the fuse bypass jumper in accordance with the preferred embodiment of the present invention.
Figure 5:
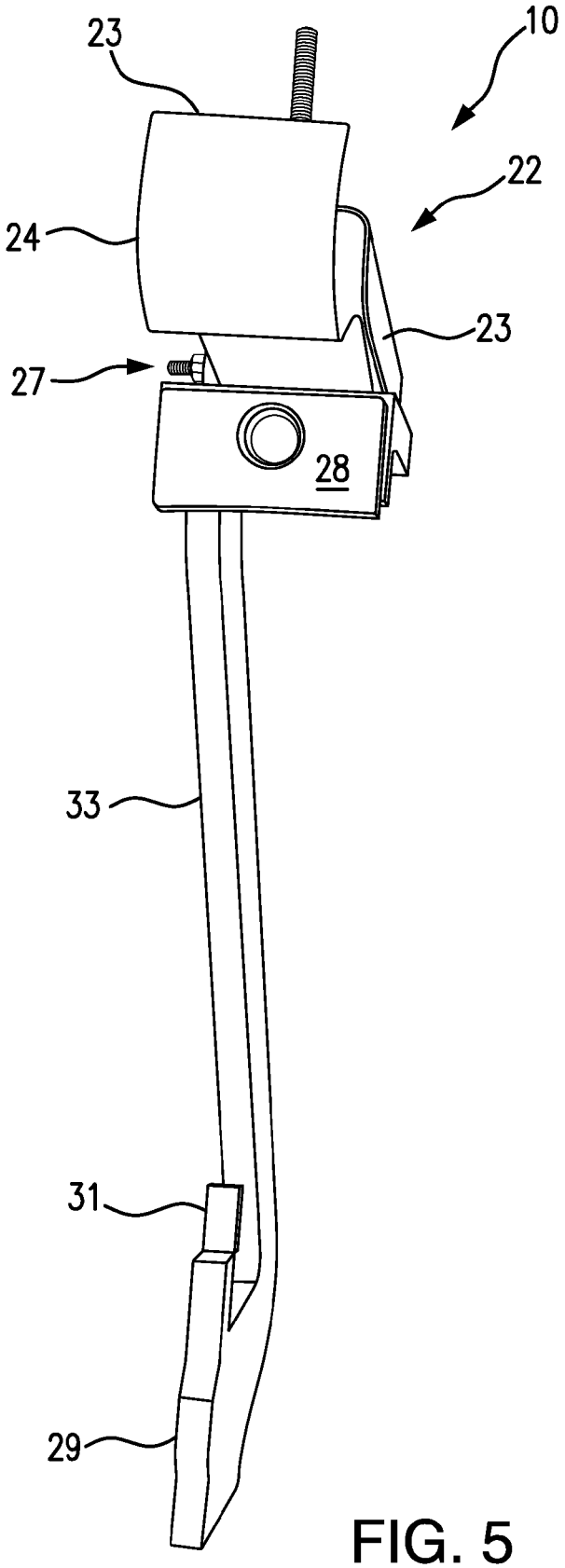
FIG. 5 is a front elevation view of fuse bypass jumper in accordance with the preferred embodiment of the present invention.

As depicted in FIGS. 3-5, the bypass jumper 10 comprises a heavy gauge bar of highly conductive metal, such as copper, or metal alloy, in a configuration resembling the letter "G". The jumper 10 has an upper arm 22, which comprises a U-shaped arcuate channel arch 23, with its open side downward, within which is a horizontally-oriented upper blade spring 24, the distal end of which extends beyond the channel arch 23 and terminates in an upturned convex leading edge 25. Below the channel arch 23 and the upper blade spring 24 is a channel flange 26, which, together with the channel arch 23 and the upper blade spring 24, defines a spring-tensioned, horizontal upper channel 27 in the upper arm 22 of the jumper 10. The vertically-oriented distal end of the flange 26 forms a channel block 28, which defines the terminus of the upper channel 27.

The jumper 10 also has a lower arm 29, which extends horizontally and then bends upward to define a vertical V-shaped lower notch 30, with two cooperating vertical lower blade springs 31 on its interior side. The distal end of the innermost lower blade spring 31 has an outwardly-turned convex leading edge 32. Connecting the lower 29 and upper 22 arms of the jumper 10 is a vertical jumper bar 33. The heavy gauge, highly-conductive material of the jumper 10 provides a low-resistance conductive path with an amperage rating of over 100 Amps.

Figure 6:
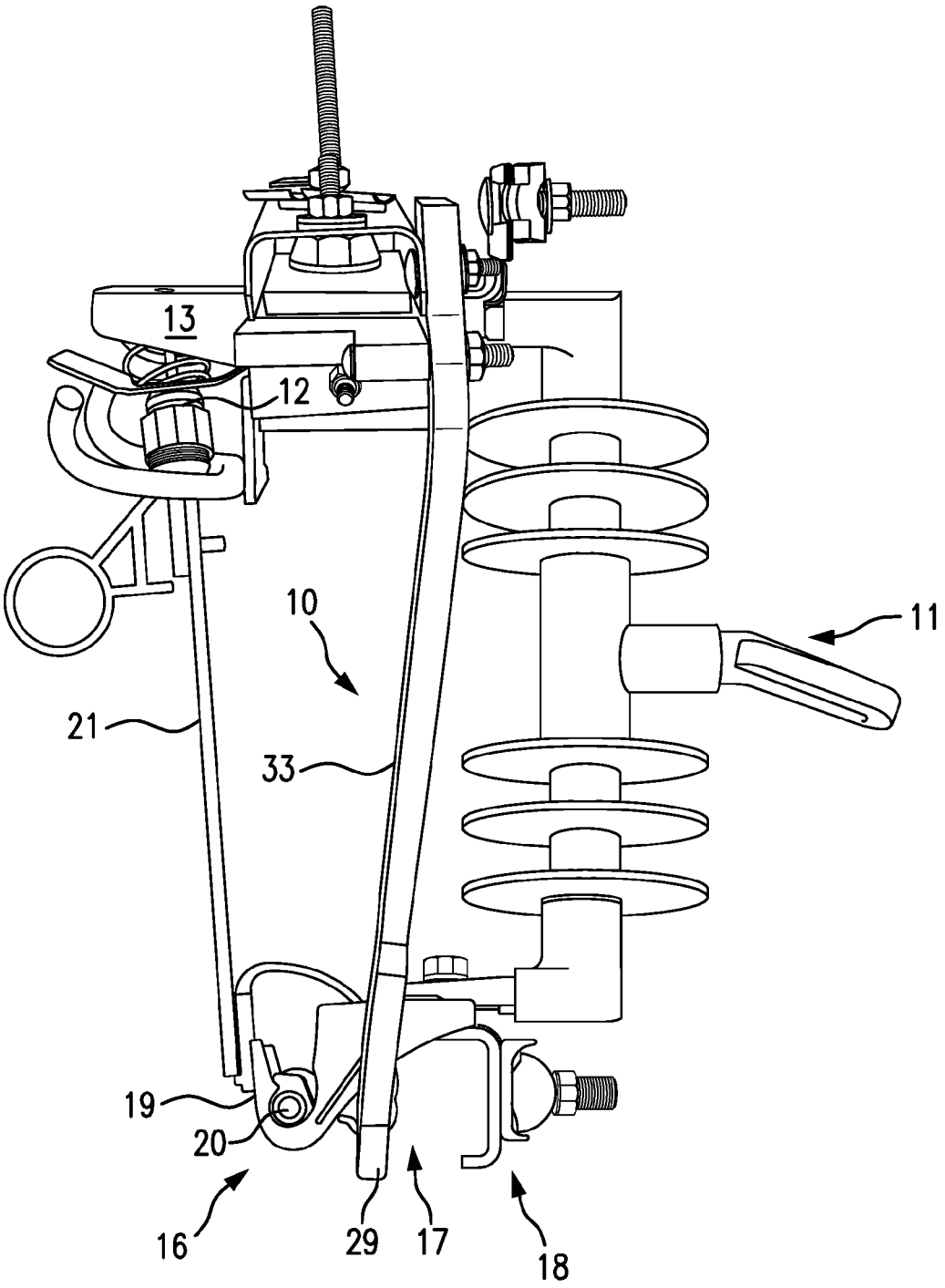
FIG. 6 is a side profile view of the closed cut-out box of FIG. 1 with the fuse bypass jumper, in accordance with the preferred embodiment of the present invention, transversely attached thereto.
Figure 7:
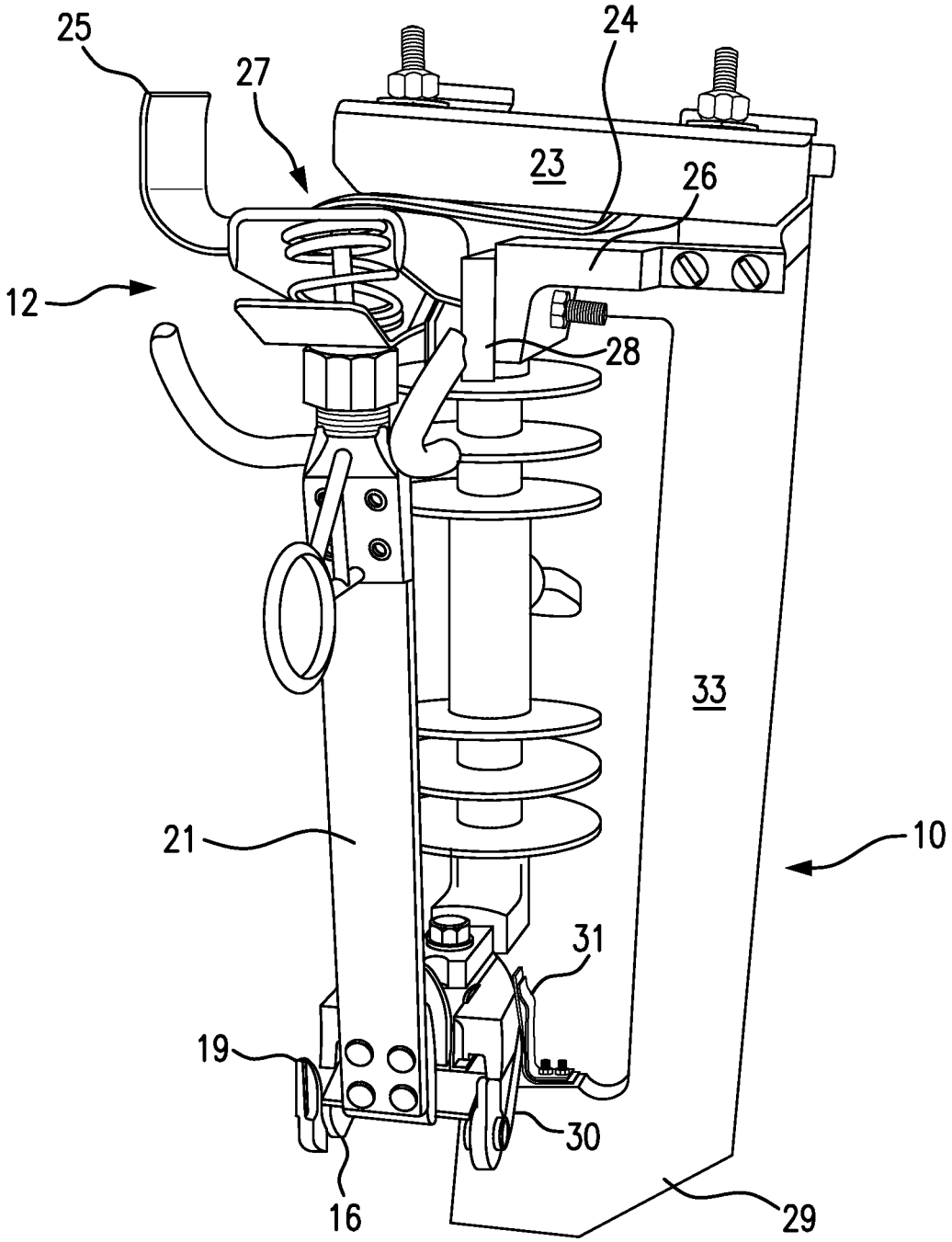
FIG. 7 is a front elevation view of the closed cut-out box of FIG. 1 with the fuse bypass jumper, in accordance with the preferred embodiment of the present invention, transversely attached thereto.
Figure 8:
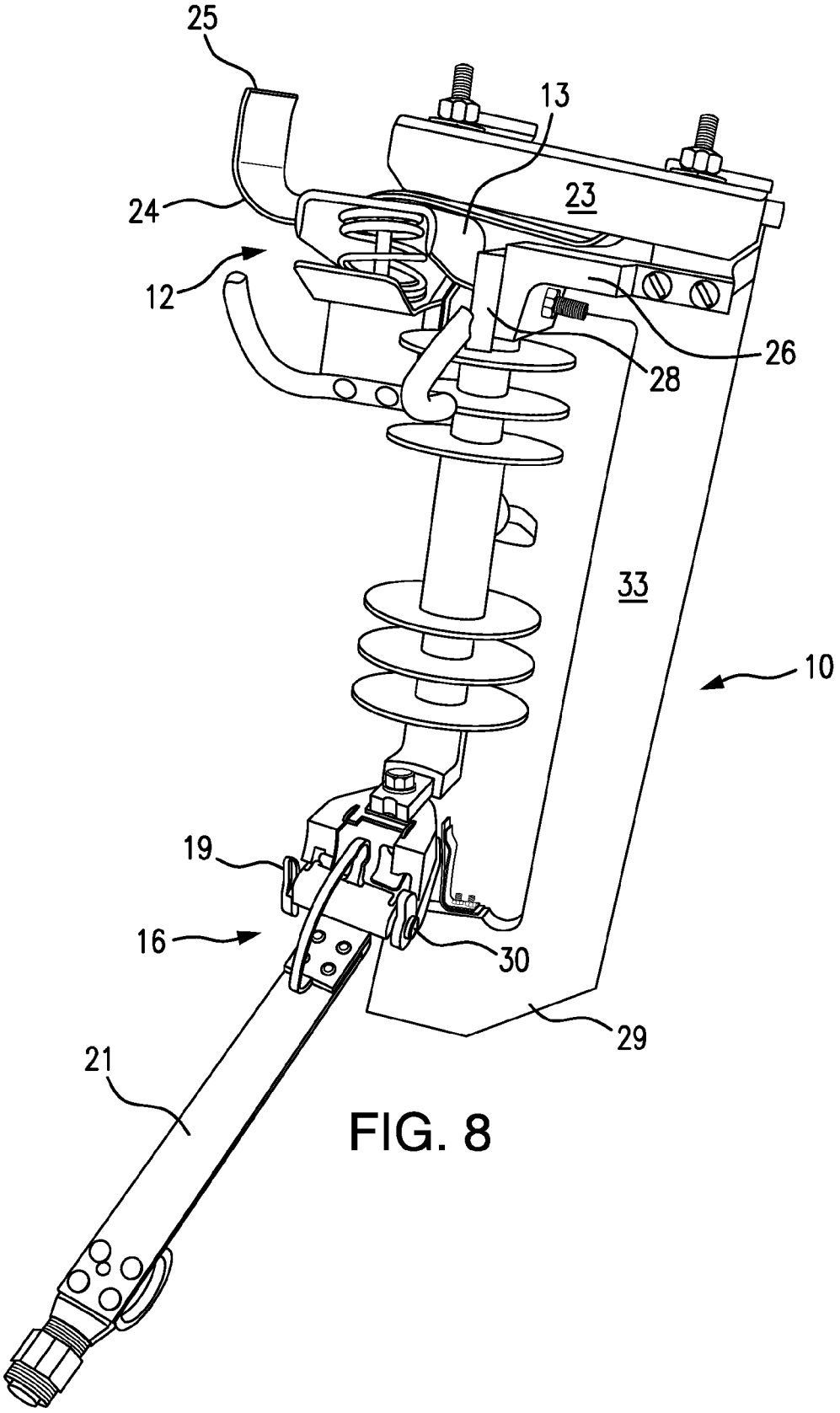
FIG. 8 is a front elevation view of the open cut-out box of FIG. 2 with the fuse bypass jumper, in accordance with the preferred embodiment of the present invention, transversely attached thereto.

As shown in FIGS. 6-8, the bypass jumper 10 is deployed by orienting its arms 22 29 perpendicularly to the arms 14 18 of the cut-out box 11, then hooking the notch 30 of the lower arm 29 transversely onto the lower terminal extension 17, with the incidental deflection of the lower blade springs 31 providing the tension to keep this connection secure. The upper arm 22 of the jumper 10 is then angled forward so that the leading edge 25 of the upper blade spring 24 transversely engages the upper terminal extension 13 of the cut-out box 11, which then slides into the horizontal upper channel 27 of the jumper 10 until it engages the flange block 28. The upper blade spring 24 provides the tension to keep this connection secure.

With the jumper 10 thus placed, it completes the circuit of the transmission line through the cut-out box 11 independently of the fuse element 21, so that the fuse 21 can be removed or replaced without interrupting the high-voltage transmission circuit.

The advantages of the bypass jumper of the present invention 10 are that it can be deployed by a single workman and it can handle very large current loads above 100 Amps.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A fuse bypass jumper for a cut-out box in a high-voltage electrical transmission line circuit, wherein the cut-out box comprises a first fuse terminal, which communicates electrically with a first terminal extension, a second fuse terminal, which communicates electrically with a second terminal extension, and a fuse element, which is removably insertable between the first fuse terminal and the second fuse terminal so as to complete the transmission line circuit through the cut-out box, and wherein the bypass jumper comprises:

a channel member, defining a laterally-oriented channel, which is tensioned with one or more laterally-oriented channel blade springs, and into which the first fuse terminal or the first terminal extension is removably, transversely insertable;

a notch member, defining a longitudinally-oriented notch, which is tensioned with one or more longitudinally-oriented notch blade springs, and into which the second fuse terminal or the second terminal extension is removably, transversely insertable;

a longitudinally-oriented jumper bar, which structurally and electrically connects the channel member and the notch member;

wherein the channel member, the notch member and the jumper bar are all fabricated of a heavy-gauge, highly conductive metal or metal alloy having an amperage rating of more than 100 Amps; and wherein, when the first fuse terminal or the first terminal extension is transversely inserted into the channel and the second fuse terminal or the second terminal extension is transversely inserted into the notch, the fuse bypass jumper completes the transmission line circuit through the cut-off box independently of the fuse element, which can then be removed or replaced without interrupting the transmission line circuit.

2. The fuse bypass jumper of claim 1, wherein one or more of the channel blade springs have a convex leading edge that facilitates transverse insertion into the channel of the first fuse terminal or the first terminal extension.

3. The fuse bypass jumper of claim 2, wherein one or more of the notch blade springs have a convex leading edge that facilitates transverse insertion into the notch of the second fuse terminal or the second terminal extension.

4. The fuse bypass jumper of claim 3, wherein the channel member further comprises a longitudinally-oriented channel block, which limits the extent to which the first fuse terminal or the first terminal extension can be transversely inserted into the channel.

* * * * *